United States Patent [19]

Edwards et al.

[11] 4,154,575

[45] May 15, 1979

[54] HOT ROLL FUSER ROLL CLOSURE APPARATUS

[75] Inventors: Earl G. Edwards; Michael R. Headrick; Charles E. Peterson, all of Boulder, Colo.

[73] Assignee: International Business Machines Corporation, Armonk, N.Y.

[21] Appl. No.: 826,619

[22] Filed: Aug. 22, 1977

[51] Int. Cl.[2] ..... H05B 3/10; G03G 5/00

[52] U.S. Cl. ..... 432/60; 219/469; 355/3 FU; 100/93 RP

[58] Field of Search ..... 432/8, 59, 60, 228, 432/75; 219/216, 388, 469; 355/3 FU; 100/93 RP; 271/273, 274

[56] References Cited

U.S. PATENT DOCUMENTS

| | | | |
|---|---|---|---|
| 3,449,548 | 6/1969 | Adamek et al. | 219/216 |
| 3,754,819 | 8/1973 | Bruan | 432/60 |
| 3,809,861 | 5/1974 | Bruan | 219/216 |
| 3,834,861 | 9/1974 | McCarroll | 432/60 |
| 3,861,863 | 1/1975 | Kudsi | 432/60 |
| 3,973,844 | 8/1976 | McCarroll | 432/228 |
| 4,038,026 | 7/1977 | Wada et al. | 432/228 |
| 4,047,885 | 9/1977 | Hauman, Jr. | 432/60 |

FOREIGN PATENT DOCUMENTS

| | | | |
|---|---|---|---|
| 2652731 | 5/1977 | Fed. Rep. of Germany | 355/3 FU |

*Primary Examiner*—Henry C. Yuen

*Attorney, Agent, or Firm*—Kenneth W. Hairston; F. A. Sirr; J. Jancin, Jr.

[57] ABSTRACT

An apparatus which provides for a constant center distance between all drive components in a hot roll fusing assembly during fusing nip opening/closing. This apparatus includes a roll closure device which utilizes a high mechanical advantage toggle mechanism in conjunction with a cam drive. The toggle mechanism is comprised of a pivot arm pinned to the fuser frame and a force-cell attached to the pivot arm and the shaft through the backup roll. The backup roll is constrained to rotate about the cam shaft. When the cam rotates, it rotates the pivot arm, which in turn drives the backup roll either towards or away from the hot roll while maintaining a constant center distance between the backup roll center line and a center line through the cam shaft. The drive means for the backup roll includes a first gear drivingly coupled thereto which rotates on the same axis and which meshes with a second gear rotating on the same shaft as the cam. Thus, with power input at the cam shaft, the backup roll is driven with minimum backlash by gears whose center distance is constant regardless of backup roll position.

7 Claims, 10 Drawing Figures

HOT ROLL FUSER ROLL CLOSURE APPARATUS

BACKGROUND OF THE INVENTION

1. Field of the Invention

This invention relates generally to copier apparatus, and more particularly to a fuser assembly mechanism for driving a backup roll either towards or away from a hot roll.

2. DESCRIPTION OF THE PRIOR ART

Hot roll fuser design requires the loading and unloading of the backup roll and hot roll to accomplish fusing, to minimize backup roll temperatures, to reduce power consumption and to enhance copy handling reliability. The hot roll is usually a stationary member whereas the backup roll is moved into and out of contact with the hot roll. Since the hot roll is typically nongrounded electrically for temperature sensing and control, and to insure mechanical integrity of drive components, the backup roll is mechanically powered (rotationally) to process a copy at the fuser station. The rotated backup also serves as a power takeoff for the drive of other essential copy handling enhancement mechanism, i.e., pinch roll and backup roll scraper system. All of these requirements place severe limitations on the fuser roll closure mechanism while at the same time not degrading copy handling reliability. The typical prior art roll closure mechanism includes a lever system of low mechanical advantage. With this type of mechanism, the moving backup roll requires the use of anti-backlash gearing, chains with idlers and other associated mechanical hardware in order to minimize the effects of changing center distances between drive components. Backlash and high compliant drive components significantly reduce copy handling reliability and fuse grade through variations in time spent at the fusing nip.

OBJECTS OF THE INVENTION

It is an object of this invention to eliminate the necessity of using anti-backlash gearing, chains and belts in order to minimize the effects of changing center distances between drive components.

It is another object of this invention to provide accurate location of the backup roll, regardless of position, allowing for gear drive capability for other paper handling hardware.

It is still another object of this invention to eliminate the adjustment required of prior art anti-backlash gearing, chains and belts.

It is still another object of this invention to provide for accurate location of and maintenance of other copier hardware, e.g., scraper blade and exit ways.

It is yet still another object of this invention to lower the cam follower loads, thereby reducing the torque capacity requirement of the clutch which drives the cam shaft.

SUMMARY OF THE INVENTION

The above objects are realized through the use of a mechanism which provides for a constant center distance between all drive components in the fusing assembly during roll opening and closing; and hence, controls backlash. This roll closure apparatus utilizes a high mechanical advantage toggle mechanism in conjunction with a cam drive. The toggle is comprised of a pivot arm pinned to the fuser frame and a force-cell between the pivot arm and a shaft through the backup roll. In addition, a cradle arm constrains the backup roll to rotation about the cam shaft.

A cam follower, mounted on an extension of the pivot arm, cooperates with or follows high and low dwells on the cam as it rotates to thereby rotate the pivot arm. This movement in turn drives the backup roll either towards or away from the hot roll to thereby effect a fusing nip close or fusing nip open condition. Because the backup roll is constrained to rotate about the cam shaft, a constant center distance between the backup roll center line and cam shaft center line is maintained. This distance remains constant regardless of the position of the two rolls with respect to each other.

The drive means for the backup roll includes a first gear rotating on the same shaft as the cam and a second gear that is drivingly coupled to the backup roll and which rotates on the same axis as the backup roll. The teeth of these two gears mesh, with the first gear driving the second gear and backup roll. During nip opening and closing a constant center distance is maintained between the axis that supports the cam and first gear and the axis that supports the backup roll and second gear. Thus, with power input at the cam shaft, the backup roll is driven with minimum backlash by gears whose center distance is constant regardless of backup roll position.

A roller for transporting a fused copy out of the fusing nip is driven by a set of gearing which mates with the driver gear coupled to the backup roll. This set of gearing for driving the transport roller is carried by a link which pivots about the backup roll's axis. Hence, the set of gearing merely rotates in a circle about the gear coupled to the backup roll. Consequently, a constant center distance between all of the gearing is maintained regardless of the position of the backup roller and the transport roller is driven with minimum gear backlash.

A backup roll scraping blade cleaner, driven by a double helix leadscrew, traverses back and forth along the length of the backup roll. This cleaner, like the transport roller, derives its driving force from the driver backup roll through gears. One gear is mounted on an end of the lead screw, another gear is located on the axis of the backup roll at an end away from the other driven gear coupled to the backup roll and a third gear lies between these two gears and meshes therewith. The gear mounted on the lead screw and the third gear are both carried by the aforementioned cradle arm. Again, a constant center distance between all of the gearing is maintained regardless of the position of the backup roll. The lead screw including the roll cleaner, are driven with minimum gear backlash.

The foregoing and other objects, features and advantages of the invention will be apparent from the following more particular description of the preferred embodiment of the invention, as illustrated in the accompanying drawing.

DESCRIPTION OF THE PREFERRED EMBODIMENT

Figure 1:
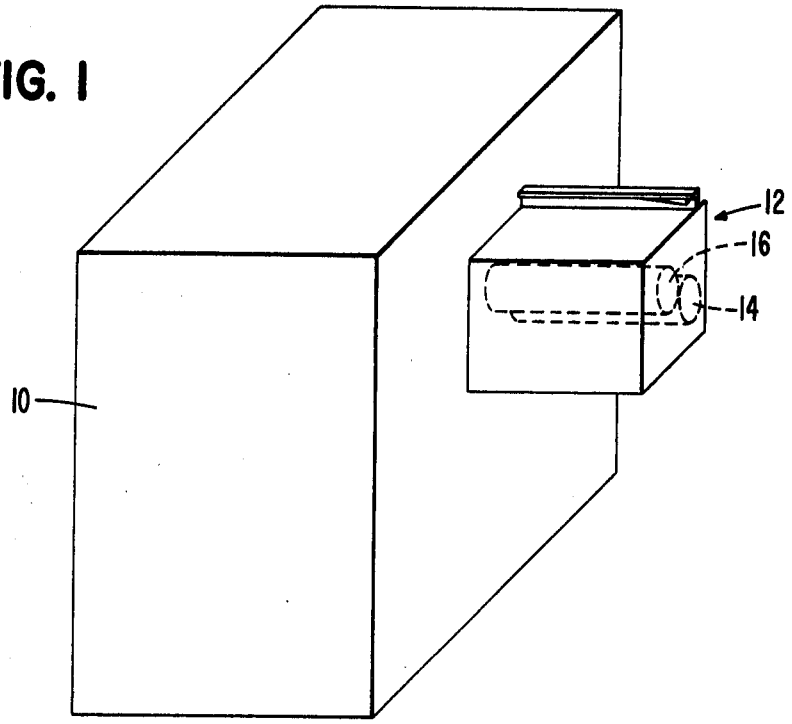
FIG. 1 is a general view of a copier incorporating the novel fuser roll closure mechanism of the present invention.

FIG. 1 is a general view of xerographic copier 10 incorporating the present invention, for example, the IBM Series III Copier/Duplicator. In this figure, fuser assembly 12 is shown in its extended or pulled-out position in front of the copier. Fuser assembly 12 is slidably supported within copier 10. Other copier means are not shown for purposes of simplicity. This is a non-operating position adapted to facilitate inspection, cleaning, repair and/or sheet jam clearance.

Figure 2:
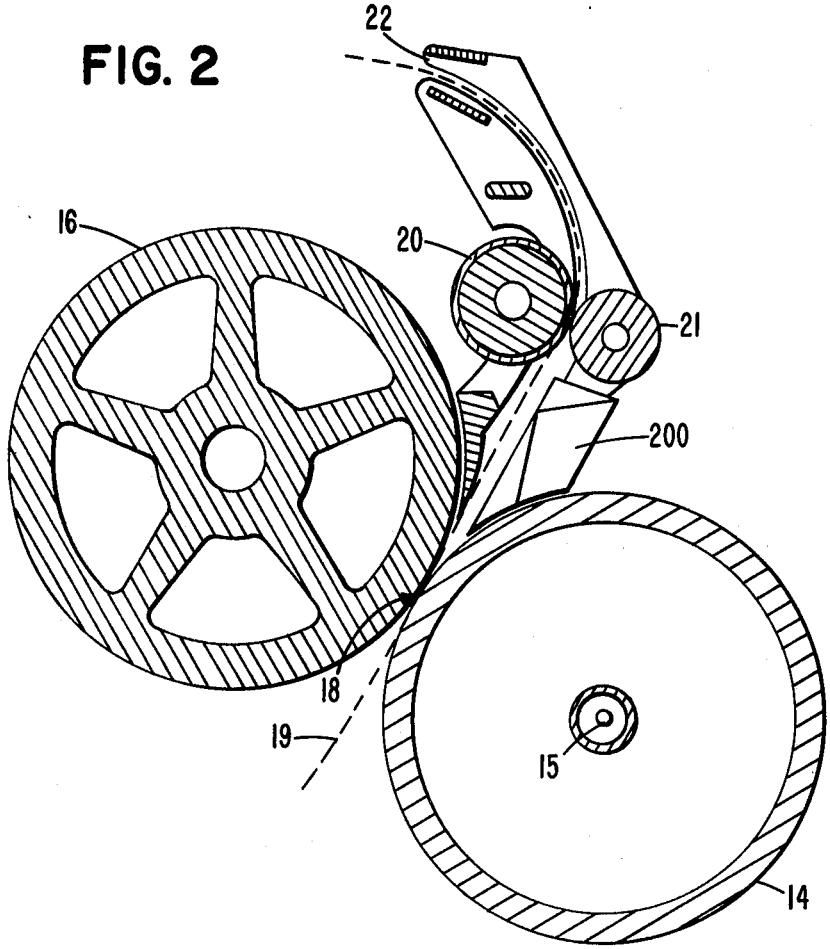
FIG. 2 is a simplified cross-sectional view, as seen from the front of the copier, of a fusing assembly.

The slidably supported fusing assembly 12 includes a hot roll 14 and a backup roll 16. Generally, hot roll 14 is heated to an accurately controlled temperature by an internal heater 15, as seen in FIG. 2, and an associated temperature control system which is not shown. Hot roll 14 preferably includes a deformable external surface formed as a thin elastomeric surface. This surface is designed to engage the toned side of a copy sheet, fuse the toner thereon and readily release the sheet with a minimum adherence of residual toner to the hot roll. As is conventional in hot roll fusers, the sheet's toned side faces the hot roll.

Backup roll 16 is preferably a relatively cool and rigid roll. Both rolls 14 and 16 are circular cylinders and the fusing nip formed thereby defines a line (of some width due to deformation of hot roll 14) parallel to the axis of rolls 14 and 16.

The fusing nip formed by rolls 14 and 16 may be opened and closed in synchronism with the arrival and departure of the copy sheet's leading and trailing edges, respectively. This syncrhonism is achieved by a drum position sensing means which responds to the position of the photoconductor drum and effects opening and closing of the nip by means of a copier control system, all not shown. In the alternative, for a multi-copy run, the fusing nip may continuously remain closed until the trailing end of the last sheet has passed therethrough.

FIG. 2 shows the fusing nip closed. Rigid backup roll 16 is shown to be in contact with resilient hot roll 14, thereby deforming the surface of hot roll 14 so as to form a fusing nip 18 of a certain width, measured in the direction of sheet movement 19. Feed roller 20 cooperating with idler roller 21 continues sheet movement 19 until a copy passing therethrough is free of fusing nip 18 and has passed through fuser exit-way or sheet transport channel 22.

Figure 3:
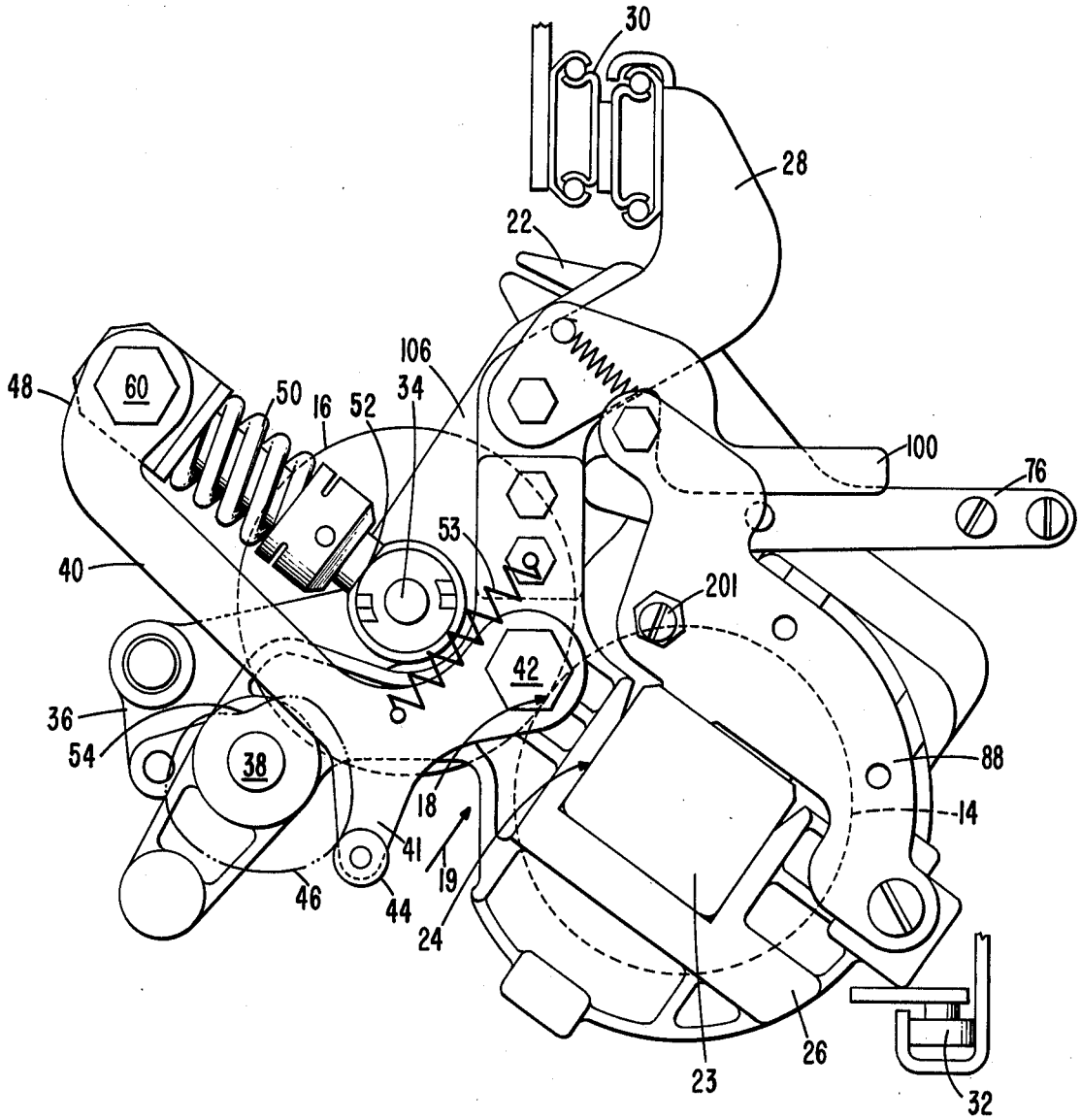
FIG. 3 is a diagrammatic view of a fusing assembly incorporating the roll closure mechanism of this invention.

In FIG. 3, hot roll 14 is removably, rotationally mounted on a fixed position axis in mounting blocks 23 which are supported by way of positioning surfaces 24 formed in the ends of a single piece mounting main frame member 26. This main frame member 26 includes a hanger 28 which supports the fuser assembly by way of telescoping rails 30. Frame member 26 also includes rollers 32 which cooperate with a copier frame member to stabilize the fuser assembly position within the copier.

Figure 10:
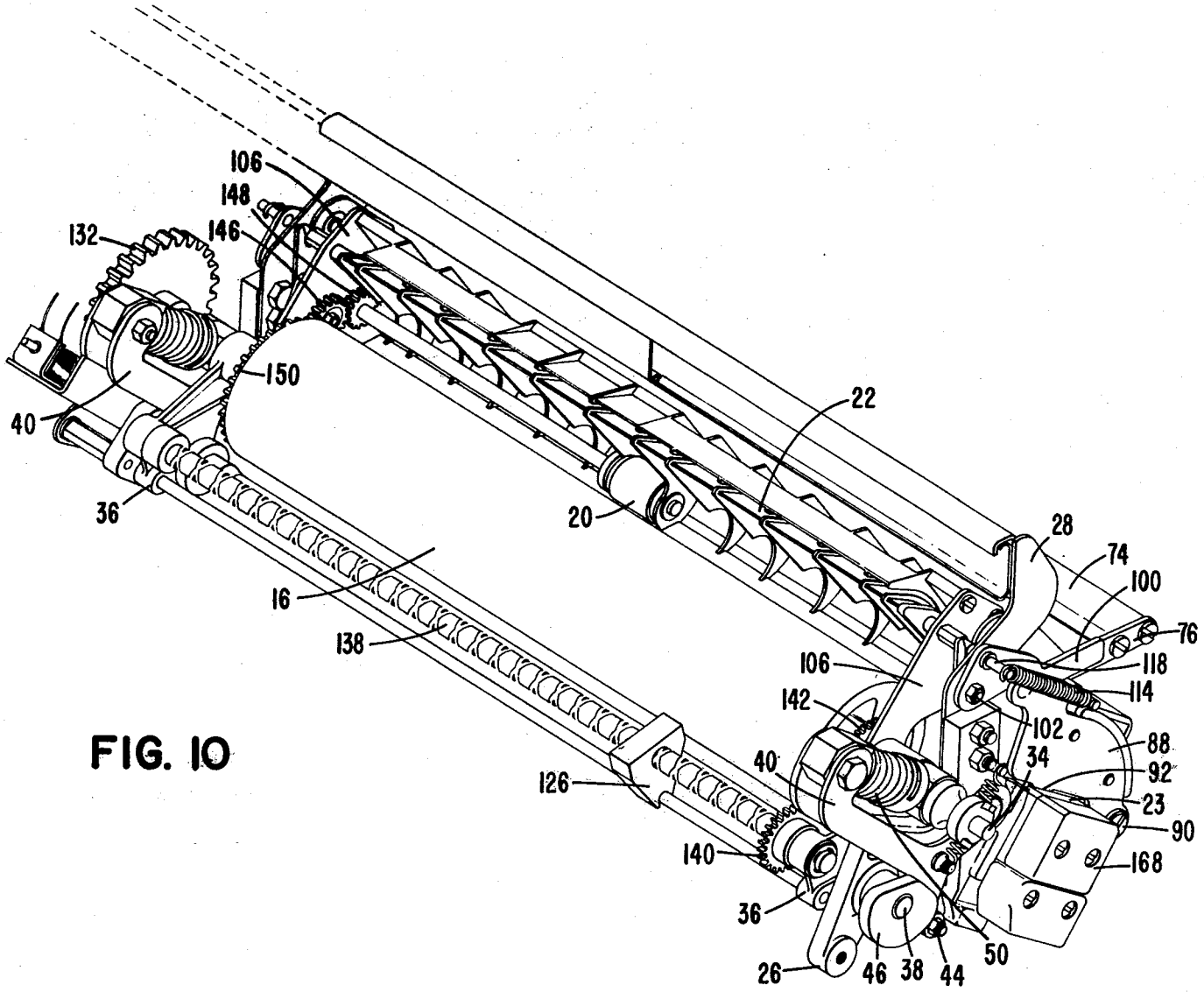
FIG. 10 is an overall perspective view of the fusing assembly.

As seen in FIGS. 3 and 10, roll 16 is rotationally supported, on axis 34, by way of pivoting cradle arms 36 at each end of frame member 26. These cradle arms are pivoted on the frame member at axis 38. Pivot arms 40, at each end of main frame member 26, are pivotably mounted to the frame member by way of pivot 42. Pivot arms 40 have downwardly extending projections 41 which support rollers 44 which cooperate with nip opening and closing cams 46. The other ends of pivot arms 40 have mounted thereon ends 48 of compressible force-cells 50. The other ends 52 of force-cells 50 operate on cradle arms 36 to cause arms 36 to rotate clockwise about axis 38, as the fuser nip is closed. In addition to rotating arms 36, force-cells 50 provide controlled pressure to backup roll 16 through axis 34, and consequently the presure to fusing nip 18 is controlled. The width of fusing nip 18 can also be adjusted by changing the pressure imparted thereto by force-cells 50. Springs 53, positioned between hanger 28 and pivot arms 40, provide an additional opening force to fuser nip 18.

The closing of fusing nip 18 is achieved by cams 46 which are rotationally mounted on axis 38. These cams include a low point 54 which, when positioned to cooperate with roller 44, establish a nip-open condition. To close the nip, solenoid 56 is energized and clutch 58, shown in FIGS. 4–6, operates to rotate cams 46, in FIG. 3, clockwise 235° (counterclockwise if observing FIG. 4) to the position shown, causing nip 18 to close.

During nip closure, pivot arms 40, in FIG. 3, rotate counterclockwise causing fixed-position pivot 42, force-cell pivot 60 and axis 34 to come into substantial alignment. However, pivot point 60 does not move over center. Thus, subsequent rotation of cams 46, back to the nip open cam position 54, as a result of the de-energization of solenoid 56, allows force-cell 50 to rotate pivot arms 40 clockwise (when observed on FIG. 3) about pivot 42, opening fusing nip 18.

Figure 5:
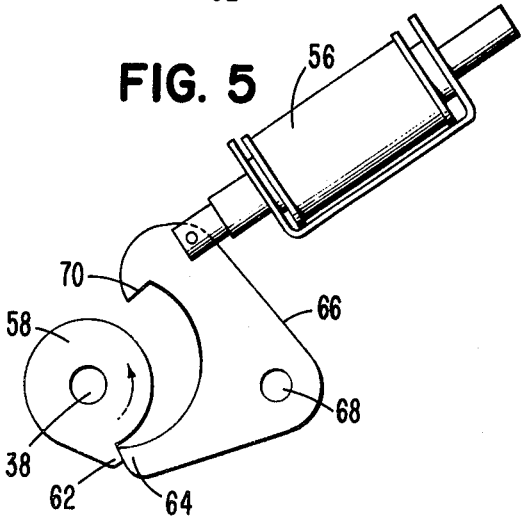
FIGS. 5 and 6 are exploded diagrammatic views of the solenoid, pivoting link and clutch as seen in FIG. 4.
Figure 6:
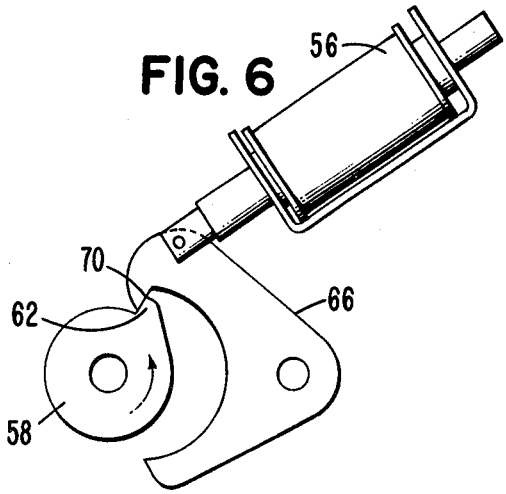

Cams 46 rotate on axis 38 as long as clutch member 58 is free to rotate (see FIGS. 5 and 6). In the de-energized position of solenoid 56, dog 62 is held against rotation by tab 64 on pivoting link 66. Link 66 is pivoted at fixed position pivot 68. When solenoid 56 is energized, clutch member 58 and cam 46 are driven 235° until dog 62 engages tab 70. Fusing nip 18 is now closed. Subsequently, when it is desired to open the fusing nip, solenoid 56 is de-energized, link 66 returns to its de-energized position, and clutch member 58 rotates until it is stopped by tab 64. Fusing nip 18 is now opened.

Figure 4:
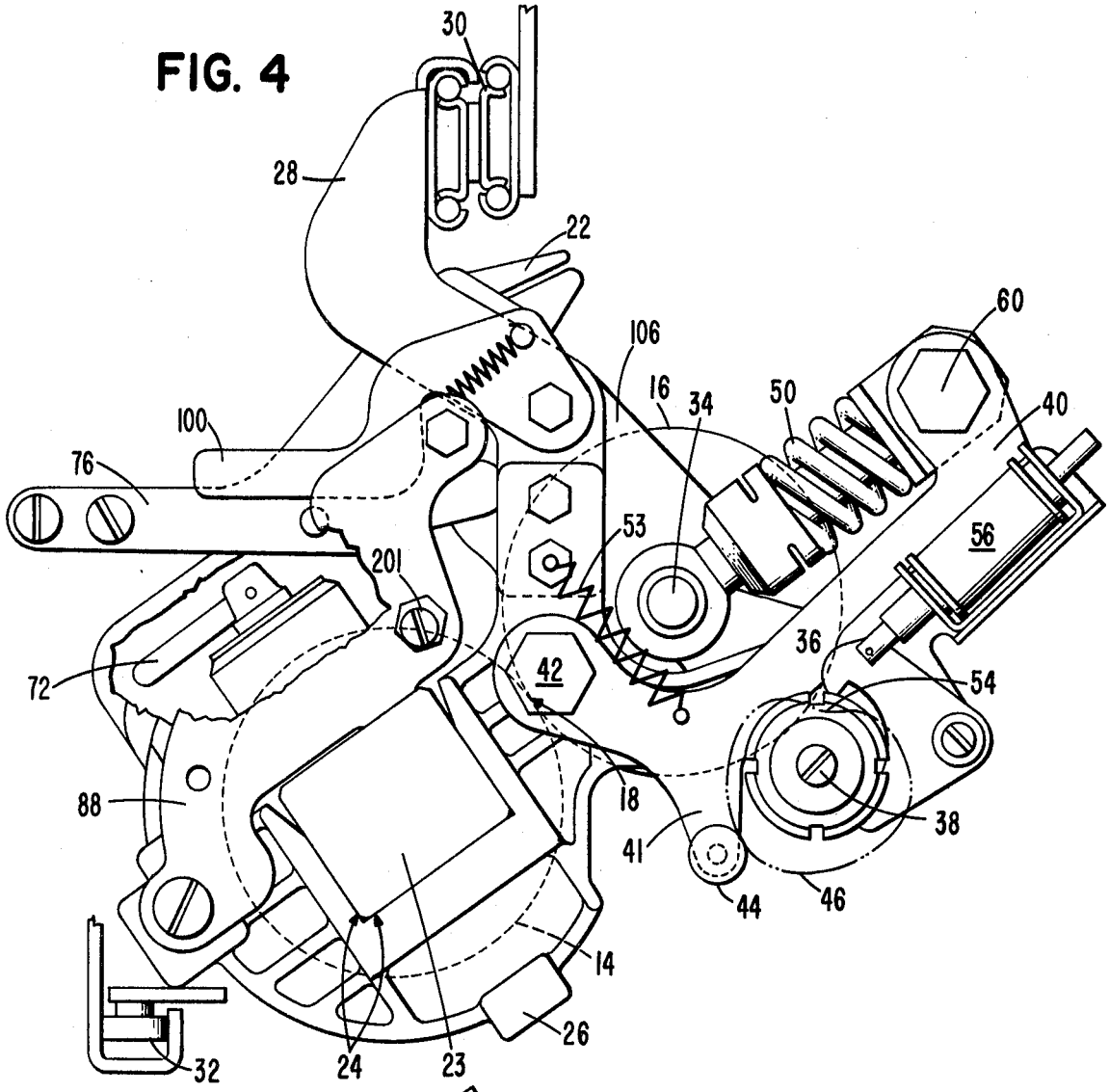
FIG. 4 is a diagrammatic view of a fusing assembly as in FIG. 3, but seen from the opposite side.

In the fragmented portion of FIG. 4, a folded handle 72, for manually removing hot roll 14, is shown. The use of this handle for removing hot roll 14 from the fusing assembly is more specifically described and claimed in a copending application, entitled "Apparatus for the Reversal of a Hot Roll in a Fusing Assembly", issuing Oct. 17, 1978 as U.S. Pat. No. 4,121,089 and assigned to the same assignee as the instant invention.

Figure 7:
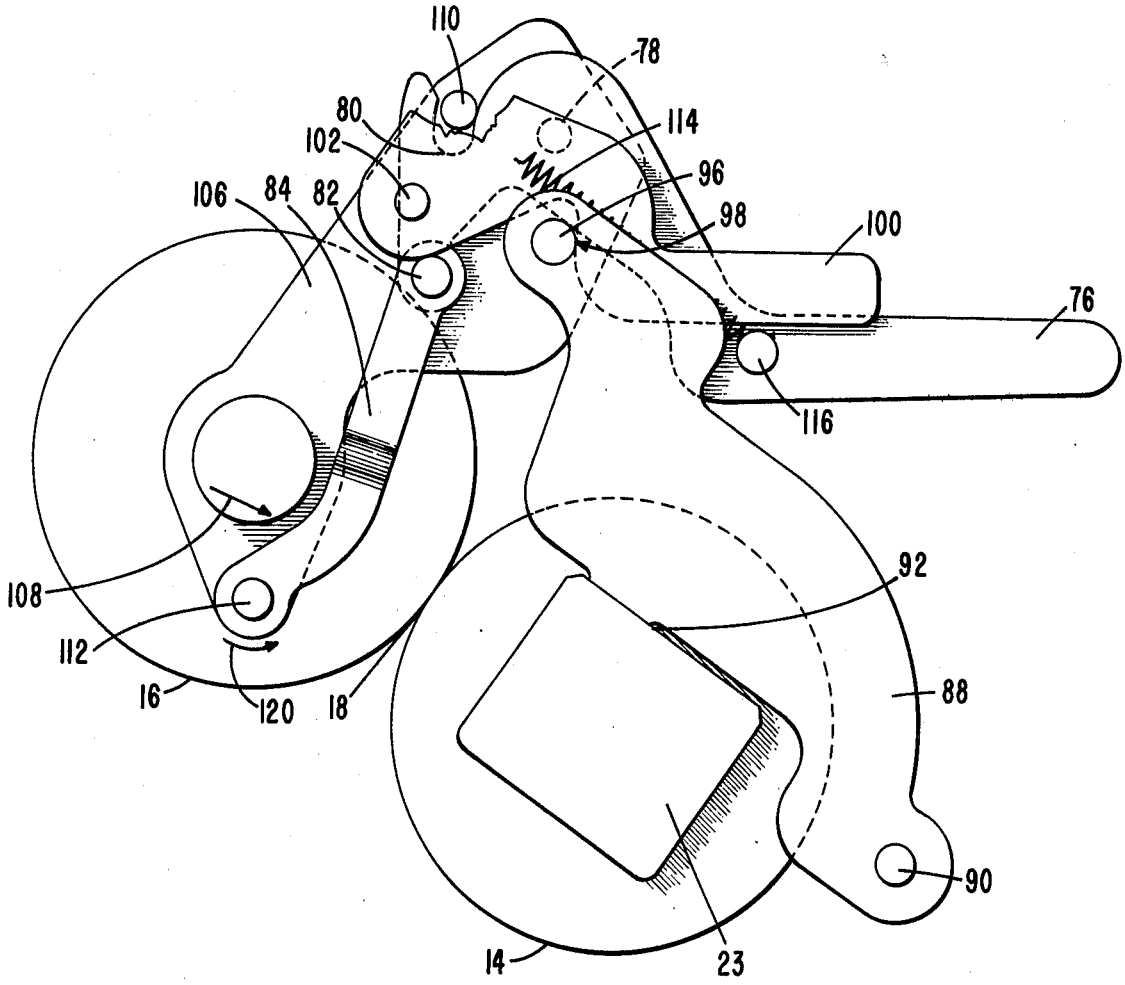
FIG. 7 is a diagrammatic view of a mechanism used in conjunction with the fuser assembly of this invention to move associated hardware to facilitate access to the hot roll and backup roll area.
Figure 8:
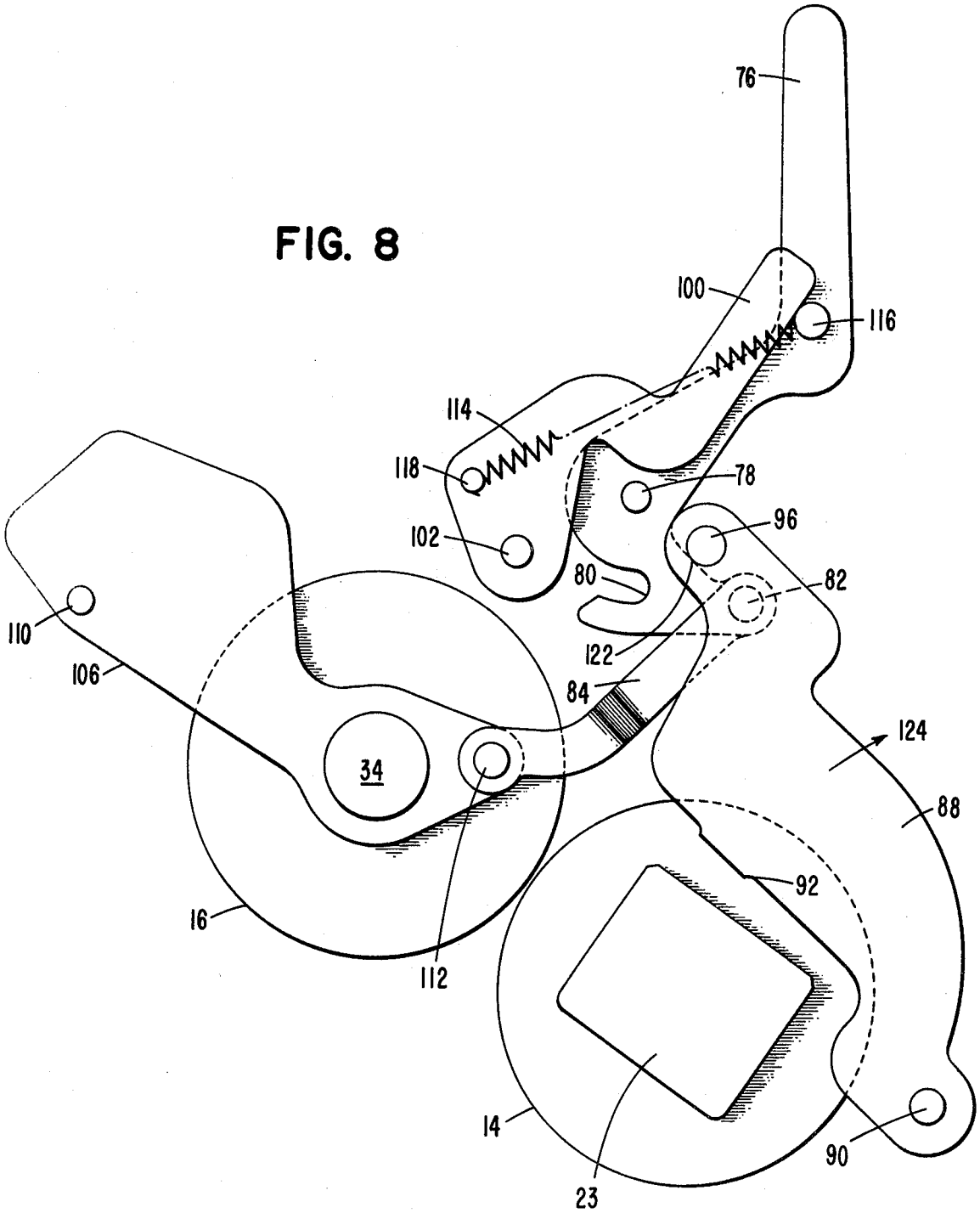
FIG. 8 is a diagrammatic view as in FIG. 7, with the associated hardware moved out of the way for access to the hot roll and cold roll.

In FIG. 10, a manually movable, rod-like handle 74 extends the length of the fuser assembly, parallel to axis 34. Opposite ends of this handle are attached to movable links 76, at each end of the fuser assembly. In FIGS. 7 and 8 it is seen that these links are pivoted on fixed-position axis 78. Both of the links have a notch 80, and a pivot point 82 for one end of a drive arm 84. In FIG. 7, links 76 are shown in their operative positions, wherein the hot roll detach bar (not shown) and the fuser's output sheet transport channel (not shown) are located closely adjacent the downstream portion of fusing nip 18 (shown closed). U.S. Pat. No. 3,955,813, commonly assigned and incorporated herein by reference, describes this sheet output channel and describes and claims the detach bar.

In FIGS. 7, 8 and 10, links 88 are pivoted on fixed-position axis 90. Each of links 88 has a projection 92 thereon for holding mounting blocks 23 securely within main frame 26. Links 88 carry locking pins 96 which lock links 88 (and the detach bar) in operative position by virtue of an interface at 98 between pin 96 and pivotable links 100. Links 100 are pivoted on fixed-position axis 102.

The ends of the above-mentioned output sheet transport channel are attached to links 106. These links are pivoted on backup roll axis 34. Axis 34 is not a fixed-positioned axis because during nip closure, axis 34 moves a slight distance downward, as represented by arrow 108 in FIG. 7.

The upper end of links 106 carries a locking pin 110, cooperating with notch 80 formed in links 76. The lower end of links 106 carries lower pivot axis 112 for the end of drive arm 84 that is opposite pivot point 82.

In FIG. 8, two tension springs 114 extend between pins 116 carried by links 76 and pins 118 carried by links 100. The springs provide a closing force between links 76 and links 100, when in jam-clearing position, as in FIG. 8. In addition, springs 114 provide a contacting force between locking pins 96 and pivotable links 100, when in the operating position, as in FIG. 7. The above-mentioned interface 98 is created by these latter two sets of links.

In order to move the above-mentioned detach bar 200 and output sheet transport channel 22 out of the way for jam clearance or to remove hot roll 14, the above-mentioned rod-like handle 74 and its links 76 are rotated counterclockwise about fixed-position axis 78, to the position shown in FIG. 8. Opposite ends of detach bar 200 are attached to links 88, as by fasteners 201 (see FIGS. 3 and 4). Opposite ends of sheet transport channel 22 are connected to links 106 (see FIG. 10). Counterclockwise rotation of handle 74 causes the detach bar to generally rotate clockwise about hot roll 14 away from fusing nip 18, and the output sheet transport channel to generally rotate counterclockwise about backup roll 16.

During such movement, pins 116 on links 76 engage links 100 and cause these links to pivot counterclockwise about their fixed-position axis 102. As a result, interface 98, as seen in FIG. 7, created by contact between pins 96 and pivoted links 100 is broken. In FIG. 8, as handle-actuated links 76 continue to rotate counterclockwise, notches 80 free pins 110. Counterclockwise rotation of links 76 transmits counterclockwise rotation to links 106 by virtue of drive arms 84. As pivot axis 112 moves counterclockwise as represented by arrow 120 in FIG. 7, to its position in FIG. 8, links 106 are pivoted clear of fusing nip 18. As counterclockwise rotation of links 76 continues, surfaces 122 formed thereon engage locking pin 96, causing links 88 to rotate clockwise about their fixed-position axis 90.

The detach bar and output sheet transport channel have now been moved clear of the fusing nip for jam clearance. In addition, link 88 has been pivoted clockwise, eliminating the interface between projection 92 on links 88 and mounting blocks 23. Links 88 can now be manually rotated clockwise, as represented by arrow 124 in FIG. 8, in order that hot roll 14 can be removed from main frame 26.

In summary, interface 98 locks the detach bar in operative position, notch 80 and pin 110 lock the output sheet transport channel in operative position, spring 114 maintains interface 98, pin 116 lifts link 100 to interrupt interface 98, counterclockwise rotation of link 76 frees pin 110 and rotates link 106 by virtue of drive arm 84, and counterclockwise rotation of link 76 rotates link 88 clockwise as a result of interface with locking pin 96.

A jam clearance means of the above-mentioned generic type is described and claimed in copending application Ser. No. 771,126, filed Feb. 22, 1977, now U.S. Pat. No. 4,110,068, and assigned to the assignee of the instant invention.

Figure 9:
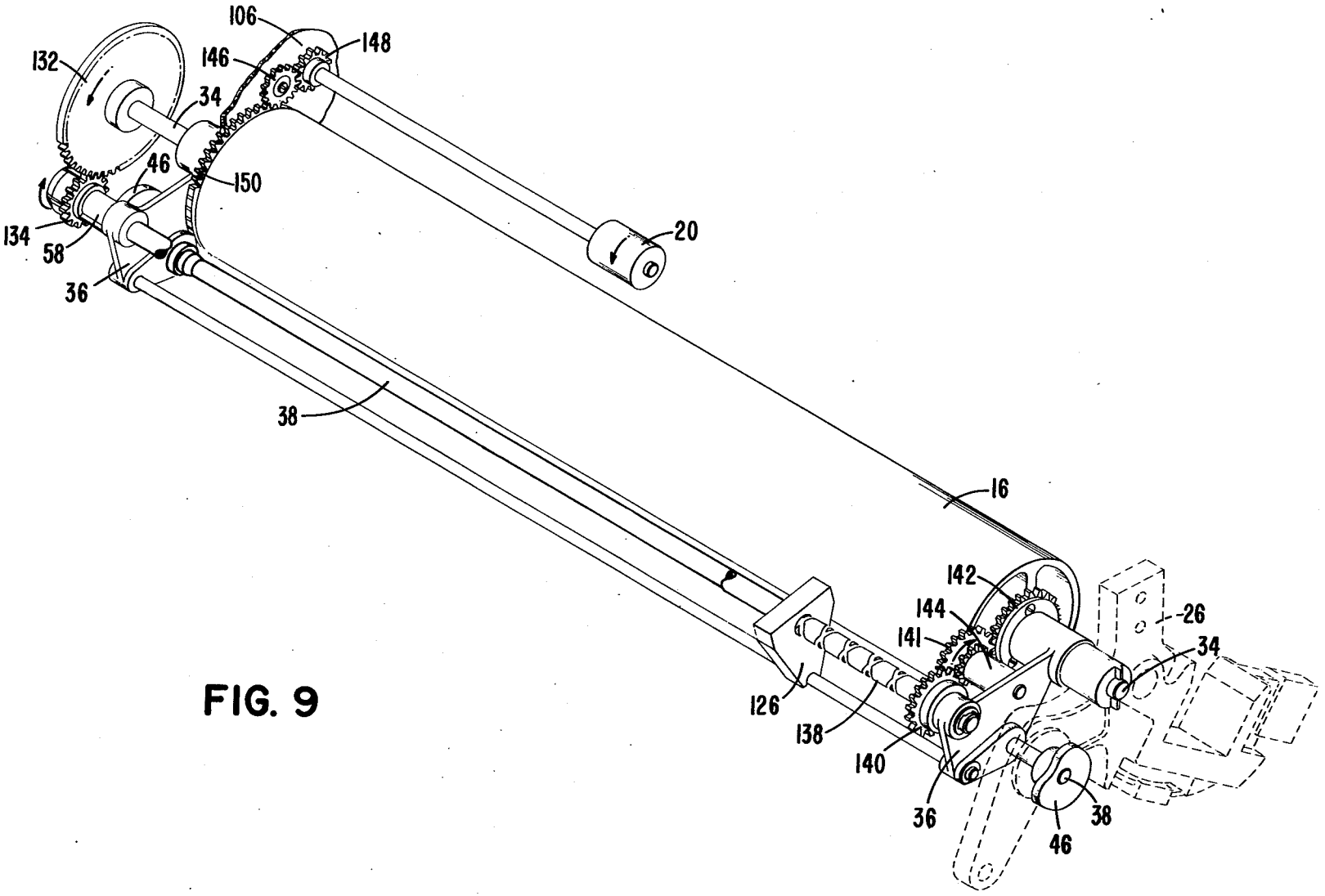
FIG. 9 is a perspective view of the fixed center drive for producing rotation of the backup roll, the backup roll's scraping blade cleaner and the fuser's paper exit guide transport roller.

FIG. 9 shows the fixed center drives for (1) producing rotation of the fuser's backup roll 16; (2) producing oscillatory movement of the backup roll's scraping blade cleaner 126; and (3) producing rotation of the fuser's paper exit guide transport roller 20. Roller 20 is supported by the exit paper transport guides, and engages the non-toner side of a sheet, as the sheet emerges from fusing nip 18. Additional information pertaining to the handle cleaner 126 appears in IBM TECHNICAL DISCLOSURE BULLETIN, Volume 18, No. 2, July 1975, pages 326–327.

Counterclockwise rotation of backup roll 16 is produced by gear 132 which meshes with continuously driven gear 134. Gear 132 is connected to the backup roll's axis 34 and causes counterclockwise rotation of this roll. When the fusing nip is being closed or opened, the backup roll's rotational axis 34 moves in an arc about axis 38. Thus, gear 132 merely rolls about its meshing gear 134.

Cleaner 126 is supported by double helix lead screw 138. This lead screw is driven in a counterclockwise direction by virtue of gears 140–142 with gear 140 being fixedly mounted on an end of lead screw 138, gear 141 being rotatively mounted on fixed axis 144 and gear 142 being fixedly mounted on axis 34. Since all of these gears are carried by cradle arm 36, a fixed center relationship is maintained during nip opening and closing.

As a sheet of newly fused copy paper emerges from the using nip, and as it is driven by counterclockwise rotation of backup roll 16, its leading edge is guided into the output sheet transport channel (not shown in FIG.9). This sheet channel is supported by pivoting links 106. The link 106 which is located at the rear end of the fuser, and is shown in FIGS. 9 and 10, carries a pair of gears 146, 148 which mesh with a gear 150 which is integral with backup roll 16. Counterclockwise rotation of sheet transport roller 20 by gears 146, 148 and 150 transports the copy paper out of the fusing nip. Roller 20 cooperates with idler roller 21, shown in FIG. 2, to trap the copy sheet therebetween. The idler roller engages the toned side of the copy sheet.

When the fuser's sheet detach bar and output sheet transport channel are manually moved out of the way, as for jam clearance, links 106 rotate in a counterclockwise direction as discussed above with reference to FIGS. 7 and 8. Since link 106 pivots about the backup roll's rotational axis 34, a fixed center is maintained for gears 146, 148 and 150, and gears 146 and 148 merely rotate in a circle about gear 150. Consequently, a constant center distance between the gears is maintained and transport roller 20 is driven with minimum backlash by the gearing.

STATEMENT OF THE OPERATION

In the high mechanical advantage toggle mechanism of this invention, cam follower roller 44, mounted on an extension of pivot arm 40, cooperates with nip opening/closing cam 46 as it is rotated. Cam 46 has high and low dwells with each having a detent to thereby stabilize the position of cam follower roller 44 in both the opened and closed positions. In FIG. 3, a low detent can be seen at the cam low point 54. When a high dwell of rotating cam 46 approaches cam follower roller 44, the end of pivot arm 40 supporting the cam follower roller moves in a counterclockwise arc and the other end of the pivot arm on which force-cell 50 is mounted also moves in a counterclockwise arc. Simultaneously, cradle arm 36, with one end pivotally mounted on axis 38, pivots its other end, with backup roll 16, in an arc that is clockwise. Once high dwell detent has been achieved, rolls 14 and 16 are fully loaded together and fusing nip 18, as seen in FIG. 3, is established. Rotating from high dwell to low dwell reverses the aforementioned movements until low dwell detent is achieved. At this position, rolls 14 and 16 are in their completely open position. A constant center distance is maintained between axis 34 and axis 38, regardless of whether fusing nip 18 is opened or closed.

As seen in FIGS. 9 and 10, counterclockwise rotation of backup roll 16 is produced by gear 132 which meshes with driven gear 134. During nip opening and closing, a constant center distance is maintained between axis 38 and axis 34 because the backup roll's rotational axis 34 moves in an arc about axis 38. Thus, with power input at driven gear 134, the backup roll is driven with minimum backlash by gears whose center distance is constant regardless of backup roll position.

In FIG. 9, transport roller 20 is driven by gears 146, 148 and 150. Gears 146 and 148 are mounted on link 106 which pivots about the backup roll's axis 34. As a result of this fixed pivot, the center distance between the gears is constant and transport roller 20 is driven with minimum gear backlash.

As seen in FIGS. 9 and 10, backup roll scraping blade cleaner 126, driven by double helix lead screw 138, traverses back and forth along the length of backup roll 16. Gears 140-142, each of which is mounted on cradle arm 36, provide a driving force to lead screw 138. A benefit resulting from all three gears being mounted on cradle arm 36 is that the distance between the gears is always constant. Additionally, blade contact force as well as blade contact angle of cleaner 126 with backup roll 16 are also constant, regardless of the position of backup roll 16.

While the invention has been shown and described with reference to a preferred embodiment thereof, it will be appreciated by those of skill in the art that variations in form may be made therein without departing from the spirit and scope of the invention.

What is claimed is:

1. In a hot roll fuser for a xerographic copier having a hot roll and a backup roll arranged therein to be relatively movable between open and closed positions so that in the closed position the rolls pressure engage to form a fusing nip, the combination comprising:

means for mounting a hot roll on a fixed axis;

first link means pivotable at one portion on a drive axis and supporting the longitudinal axis of the backup roll at a second portion;

a first gear attached to and rotating on the drive axis;

a second gear coupled to said backup roll and rotating on the axis of said backup roll;

said second gear meshing with said first gear to provide rotational movement to said backup roll;

second link means pivotable about a fixed-position pivot having an end of greatest extension from said fixed-position pivot;

said end of greatest extension, said fixed-position pivot and said longitudinal axis of said backup roll being in substantial alignment when the fusing nip is closed, said alignment not being maintained when said fusing nip is open;

compression force means connected between said end of greatest extension of said second link means and the second portion of said first link means to provide closing pressure to said fusing nip;

a cam mounted on said drive axis and rotating therewith, said cam having high and low areas along its circumference;

a cam follower roller mounted on an extension of said second link means adjacent to said cam, said cam follower roller mating with the perimeter of said cam;

said first and second link means each being pivotable about their respective pivots as the high and low areas of said cam are followed by said cam follower roller, said second link means being pivoted in a direction that is counter to the direction in which said first link means is being pivoted when a high area of said cam mates with said cam follower roller to thereby establish a fusing nip, the distance between said first and second gears remaining constant during the aforesaid movements to yield minimum backlash between the gears.

2. The hot roll fuser defined in claim 1 further including:

a third gear drivingly coupled to said backup roll;

a fourth gear mounted on an axis on said first link means, said fourth gear meshing with said third gear;

a lead screw mounted on said first link means adjacent the axis on which said fourth gear is mounted, said lead screw being parallel to said backup roll and spaced therefrom a sufficient distance to allow for contact between a roll cleaner mounted thereon and said backup roll; and a fifth gear fixedly mounted on said screw driven by said fourth gear;

said third, fourth and fifth gears each rotating with said backup roll about said first axis and the distance between said gears remaining constant regardless of the position of said backup roll.

3. The hot roll fuser defined in claim 1 wherein said cam includes a fusing nip opening recess and a fusing nip closing recess to stabilize the position of said cam follower in both the open and closed positions.

4. The hot roll fuser defined in claim 1 wherein at least one of the rolls is a resilient roll, and wherein said compression force means is adjustable to thereby adjust the width of said fusing nip.

5. The hot roll fuser defined in claim 2 further including:

a third link means pivotally mounted on the longitudinal axis of said movable-axis roll adjacent to said second gear;

a sixth gear mounted on said third link means and meshing with a seventh gear driven by said backup roll; and a seventh gear attached to said axis of said backup roll and meshing with said sixth gear; and an eighth gear mounted on said third link means and meshing with said sixth gear; said eighth gear providing movement to a shaft attached thereto and extending parallel to said backup roll, said shaft supporting, at a position spaced from said eighth gear, a roller for transporting a fused copy out of said fusing nip; said sixth, seventh, and eighth gears rotating with said backup roll about said first axis and the distance between the gears remaining constant, regardless of the position of said backup roll, to yield minimum backlash between the gears.

6. The hot roll fuser defined in claim 5 wherein said cam includes a pair of spaced recesses operable to stabilize the position of said cam follower in both the nip open and the nip closed positions.

7. The hot roll fuser defined in claim 6 wherein at least one of said rolls is resilient, and wherein said compression force means is adjustable to thereby adjust the width of said fusing nip.

* * * * *